United States Patent [19]

Wallace

[11] Patent Number: 4,790,332

[45] Date of Patent: Dec. 13, 1988

[54] SMOKE ELIMINATOR FOR CIGARETTE SMOKERS

[76] Inventor: Fred E. Wallace, 3508 California Blvd., Kissimmee, Fla. 32741

[21] Appl. No.: 769,679

[22] Filed: Aug. 27, 1985

[51] Int. Cl.[4] ..... A24F 13/06; A24F 13/08; A24F 13/22; A24F 19/00

[52] U.S. Cl. ..... 131/175; 131/330; 131/178; 131/187; 131/190; 131/202; 131/206; 131/215.1; 131/215.2; 131/215.3; 131/231; 131/238

[58] Field of Search ..... 131/330, 174, 175, 176, 131/178, 187, 190, 191, 200, 202, 205, 206, 211, 212.1, 212.2, 213, 215.1, 215.2, 215.3, 216, 231, 238

[56] References Cited

U.S. PATENT DOCUMENTS 4,200,114 4/1980 Waite ..... 131/178
4,369,798 1/1983 Jackson ..... 131/212.1

*Primary Examiner*—V. Millin
*Attorney, Agent, or Firm*—Edward M. Livingston

[57] ABSTRACT

A hand-held device eliminates smoke generated from cigarette smoking. This cigarette package-sized device completely encloses a cigarette while it is being smoked and provides two mouthpieces, one for inhaling and the other for exhaling smoke into the device. All smoke passes through two filters, a particulate filter and an odor filter, before being discharged into the ambient atmosphere.

7 Claims, 3 Drawing Sheets

SMOKE ELIMINATOR FOR CIGARETTE SMOKERS

BACKGROUND OF THE INVENTION

This invention relates to devices for reducing or eliminating cigarette smoke and more specifically to hand-held cigarette filters and holders.

In recent years cigarette smoking has come under increased attack. Nearly every state has passed anti-smoking laws which either have severely restricted smoking or prohibited smoking entirely, particularly in public places. Even private corporations have found it necessary to bar smoking altogether or alternatively make significant changes to accomodate both smoking and non-smoking employees. The major driving force behind such new laws and corporate changes is the adverse effect that cigarette smoking has on the health of non-smokers as proven by many recent studies.

The prior art includes some devices which have attempted to alleviate these problems caused by cigarette smoke. Most of these devices have used filters or such in an attempt to solve this problem. U.S. Pat. No. 4,233,998 shows a cigarette smoking apparatus similar to a pipe which filters the smoke only when the smoker inhales. It does not provide means for recapturing the smoke upon exhaling. U.S. Pat. No. 4,200,114 discloses a mask-like device for smoking cigarettes. Although the device does provide for recapture of smoke after exhaling the device is very cumbersome because it must be worn like a mask, at all times while smoking. Furthermore, it requires numerous valves for it to function properly and thus is more complex. U.S. Pat. No. 4,083,374 shows a smoking device for tobacco which uses a bag to hold exhaled smoke and keep it from contaminating the atmosphere. However, that device cannot be used with a cigarette because it is too cumbersome for convenient use. U.S. Pat. No. 4,066,088 discloses a device which encloses a cigarette while it is being smoked. Although this device keeps smoke from a burning cigarette from escaping into the atmosphere it does not provide for recapture of the smoke upon exhaling.

In summary, the prior art is devoid of any simple, hand-held, device which encloses a cigarette while it is being smoked and provides for recapture of the smoke upon exhalation by the smoker. The instant invention solves these problems with the prior art. This device eliminates all smoke from cigarette smoke by entirely enclosing the cigarette while it is burning and being smoked. Furthermore, it provides for recapture of exhaled smoke and filters all particulates and odor from the smoke before release into the ambient air.

SUMMARY OF THE INVENTION

The primary object of the instant invention is to provide a means of eliminating the contamination of ambient air caused by cigarette smoking.

Another object of this device is to eliminate the messiness associated with cigarette smoking, such as finger staining, ash scattering and undesirable odor.

A corollary object of this device is to reduce the fire hazards associated with smoking, particularly while lying in bed.

An even further object of this invention is to provide a device for accomplishing the afore referenced objects which is simple, convenient and unobtrusive in appearance and use.

The instant invention accomplishes these and other objects by use of a hand-held container having the approximate size and shape of a package of cigarettes, into which a cigarette is placed after lighting and remains throughout smoking. The device provides a mouthpiece through which the smoker inhales and a second mouthpiece into which the smoker exhales all smoke. All particulates and odor are then removed from the smoke before being discharged from the device into the ambient air by being passed through two filters—an inner filter made from HEPA or like material and an outer filter made from polyurethane foam or like material. dr

BRIEF DESCRIPTION OF THE DRAWINGS

The drawings appended hereto are as follows.

DESCRIPTION OF THE PREFERRED EMBODIMENT

Figure 3:
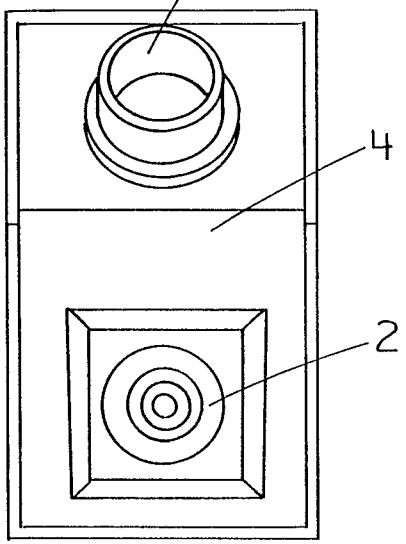
FIG. 3 is a frontal view of the invention.

Having set forth the objects of the instant device it is now necessary to describe in detail a preferred embodiment of the device as illustrated in the drawings.

Figure 2:
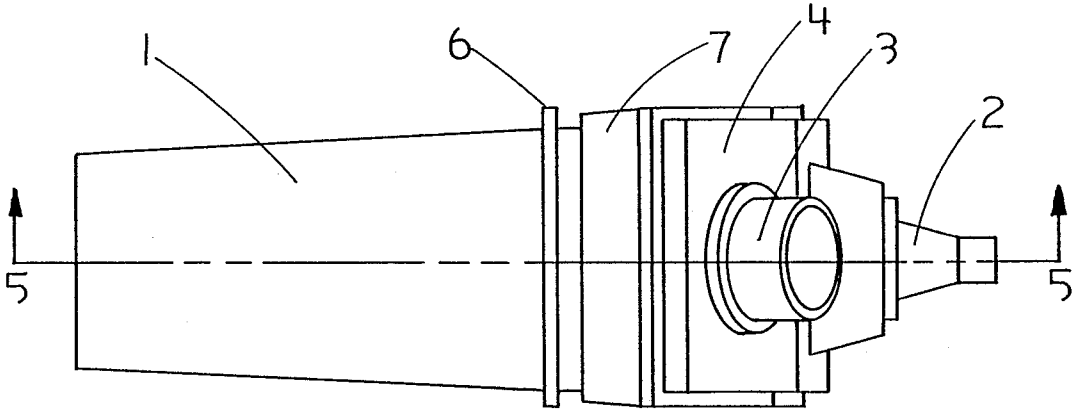
FIG. 2 is a top view of the invention.

The instant device consists of three major components, a body 7, a cover 4 and a filter retainer 6. The body 7 has two flat surfaces, one on the top designated by 27, and the other on the bottom 28, which are tapered narrower as they extend outward from the cover as best shown in FIG. 2. The body 7 has a recesses on the top and bottom, indicated by numeral 29 around its perimeter that allow it to mate with the cover 4. The body 7 has two additional recesses, indicated by numeral 23, into which it mates with the filter retainer 6. The body 7 also has three inwardly extending rib-like flat surfaces 26 to support the filter retainer 6.

The second major component, the cover 4 of the device contains two openings, one in the bottom thereof for the insertion of the inhalation mouthpiece 2 from which the user inhales his cigarette, and a second opening in the top inwardly slanted portion of the cover 4 from which extends a mouthpiece 3 into which the user exhales after each puff of the cigarette C.

The third piece of the invention is the filter retainer 6 which fits over the two flat surfaces 27 and 28 on the body 7 and has a rib 24 around its perimeter which mates into the recesses 23 in the body 7. The filter retainer 6 has two sharp ribs 25 at the outer end which mate with the flat surfaces 26 of the body 7 to form a seal around the filters 5 and 9.

The three major components of this device as described above, that is the body 7, the cover 4 and the filter retainer 6, together with the mouthpieces 2 and 3, can be made of plastic by injection molding or like materials.

Figure 1:
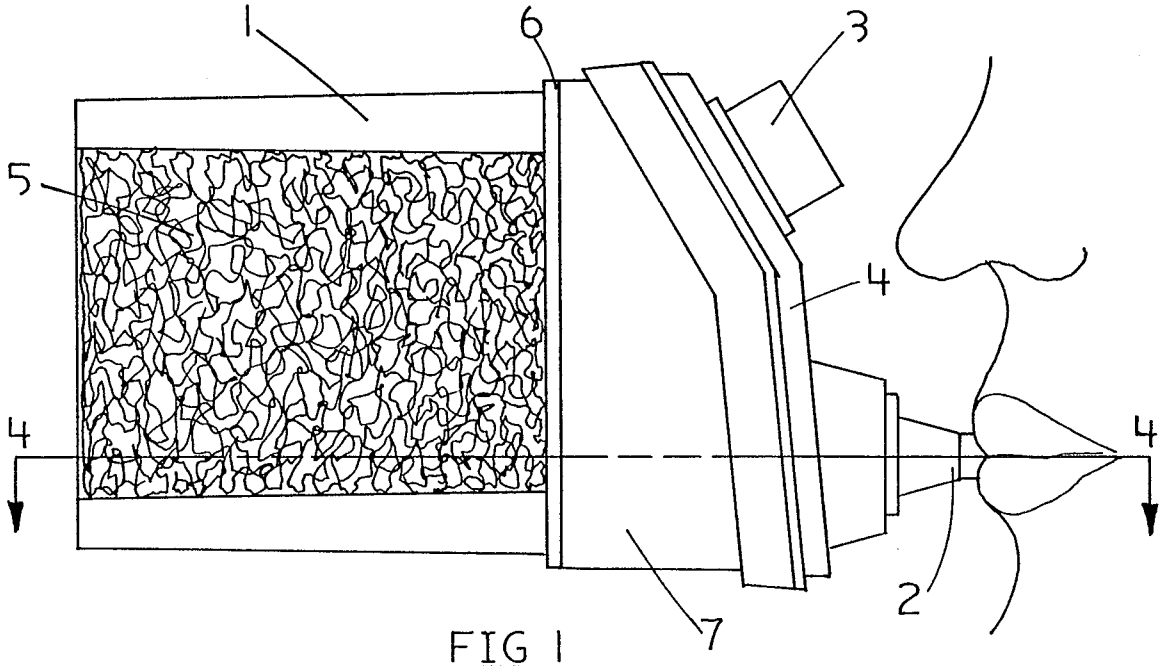
FIG. 1 is a side elevational view of the invention.
Figure 4:
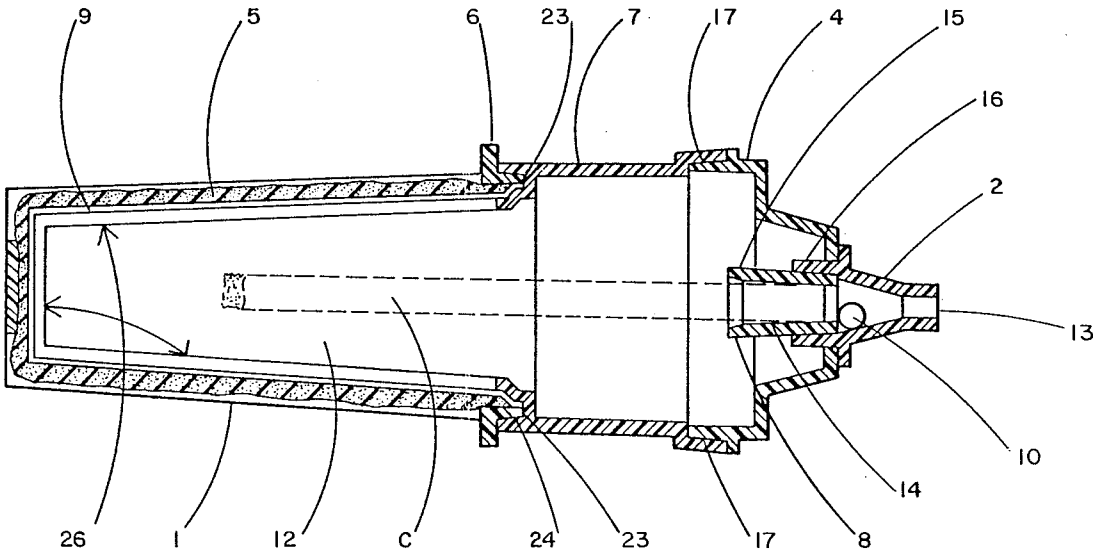
FIG. 4 is a top cross-sectional view along lines 4—4 of FIG. 1.
Figure 5:
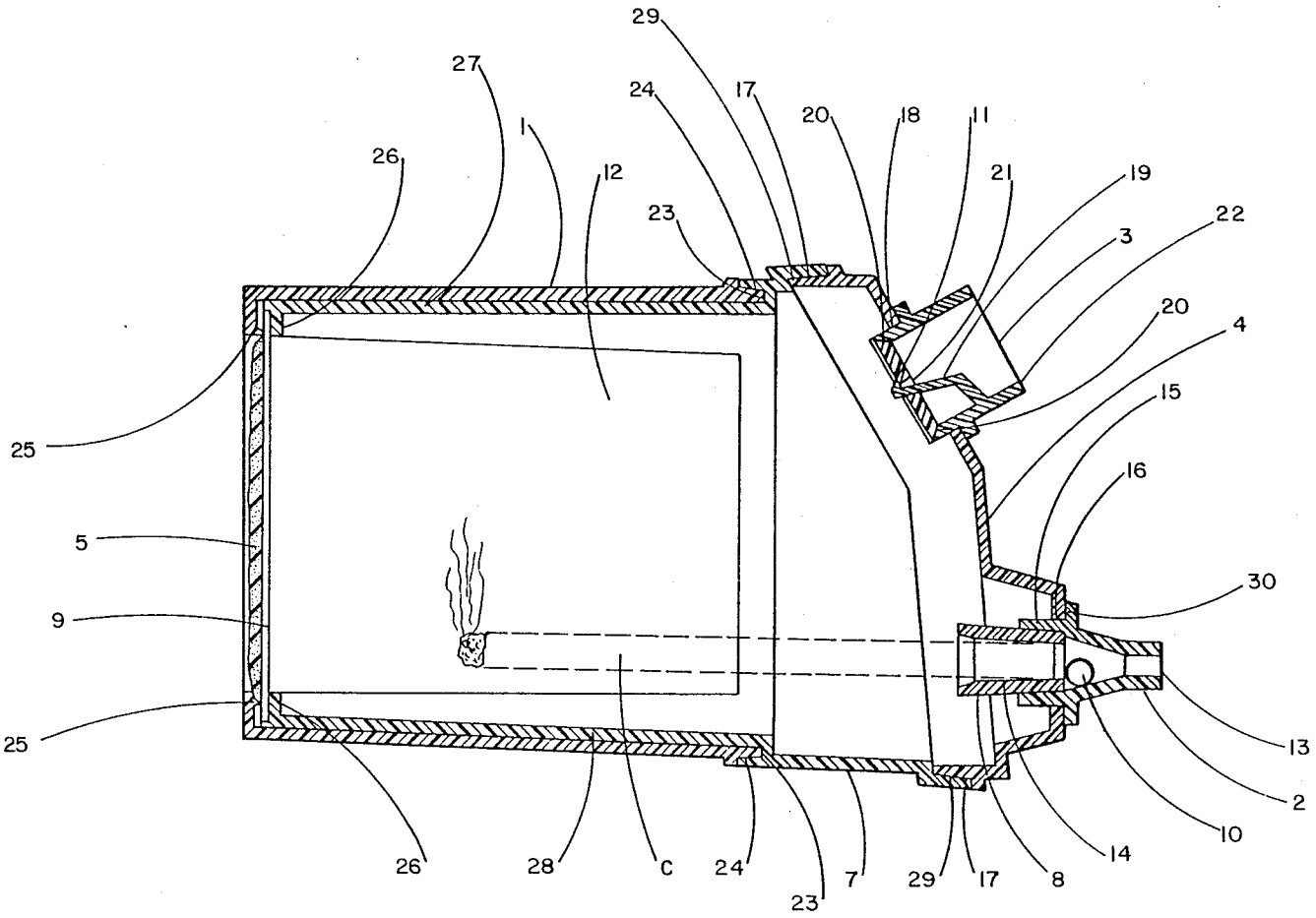
FIG. 5 is a side cross-sectional view of the invention along lines 5—5 of FIG. 2.

The interior components of the device are shown in more detail in FIGS. 4 and 5 of the drawings, FIG. 4, is a cross sectional view along lines 4—4 of FIG. 1, showing the details of the interior bottom of the device and FIG. 5 is a cross-sectional view along lines 5—5 of FIG. 2 to show the interior side of the device.

As shown in FIGS. 4 and 5, the inhalation mouthpiece 2 is press fitted into the cover 4 at 16 and is designed to be removable from the cover 4 by squeezing it between the fingers and pulling it outward. The inhalation mouthpiece 2 is tapered and narrowed and extends outward from the cover 4 to a smaller diameter at its outer end 13 for insertion in the user's mouth during smoking. The cigarette holder 8 is press fitted at its outer diameter 15 into the inner end of the mouthpiece 2. The inner diameter 14 of the cigarette holder 8 is tapered somewhat like a standard cigarette holder to accomodate cigarettes of various diameters. A small ball or bearing 10, which may be made of plastic, metal or like material is trapped between the cigarette holder 8 and the mouthpiece 2. The purpose of said ball or bearing is to allow smoke to pass freely through the inhalation mouthpiece 2 while inhaling, yet seal the inhalation mouthpiece 2 when the smoker tilts the device upward and exhales into the exhalation mouthpiece 3, thereby causing the ball 10 to block the inhalation mouthpiece 2.

The exhalation mouthpiece 3 fits into a hole in the upper slanted portion of the cover 4. The exhalation mouthpiece 3 is depicted in this preferred embodiment as having the same diameter throughout. The outer end of the exhalation mouthpiece 22 fits into the mouth of the user and smoke is exhaled through the exhalation mouthpiece 3 into the device. The inner end of the mouthpiece is pressure fitted into the cover 4 at 18. A finger 19 is molded into the inner diameter of the mouthpiece 3 and slants inward to the inner end 18 of the exhalation mouthpiece 3 where it snaps into a disc 11 by a hole 21 in the center of the disc 11 thereby forming a low pressure one-way valve. The disc 11 is tapered around the circumference thereof to allow it to mate with the inward, tapered circumference 20 at the inner end of the exhalation mouthpiece 3.

As mentioned above the filter retainer 1 fits over the upper and bottom surfaces 27 and 28 of the body 7 and contains three sides on which the two filters 5 and 9 are exposed to the ambient atmosphere. The inner filter 9 may be made of HEPA or light material for removing particulates from cigarette smoke. The outer filter 5, which may be made of polyurethane foam or like material, is impregnated with charcoal for removing odor from the air as it passes from the inside of the device through filters 5 and 9 into the ambient atmosphere. A HEPA paper filter 5 will remove 99.97% (DOP) of all particulates down to 0.4 micron in size. To insure continuing effectiveness of the device, the filters 5 and 9 are designed to be disposable and replaced after the device has been used to smoke many cigarettes, most likely by snapping it out of the body 4 and snapping on a new one.

Now having described the components of the device it will now be helpful to discuss the operation of the device. In order to use the device, the user must first remove the inhalation mouthpiece 2, which also removes with it the cigarette holder 8, by squeezing it between the thumb and first finger and pulling outward from the cover 4. Once the inhalation mouthpiece 2 has been removed a cigarette C is placed in the inner diameter 14 of the cigarette holder 8. The cigarette C is then lighted the mouthpiece 2 inserted back into the cover 4 until the inhalation mouthpiece 2 is firmly fitted at 16 and against the rib 30 to form a seal. The user then places his or her mouth over the outer end 13 of the inhalation mouthpiece and inhales.

In order to exhale the user must tilt the device toward him approximately thirty degrees, which causes the ball 10 in the inhalation mouthpiece 2 to seal the outer end 13 of inhalation mouthpiece 2 then the user places his mouth over the outer end 22 of the exhalation mouthpiece 3, and blows the smoke into the exhalation mouthpiece 3, which pushes the disc 11 inward allowing all smoke to pass into the interior cavity 12 of the device where it is forced through the inner "particulate-removing" filter 9 and the outer "odor-removing" filter 5 into the ambient atmosphere as clean air. The repetition of this sequence may enable smokers to smoke in places where it may now be restricted or prohibited without interfering with the rights of non-smokers.

In summary, the distinct advantages of the instant device are readily apparent. The instant device provides a simple convenient and unobtrusive means of eliminating the contamination of ambient atmosphere from cigarette smoking and reducing the messiness associated with cigarette smoking, such as finger staining and ash scattering. Now, with this device, a smoker can smoke a cigarette in places where it would normally be restricted or prohibited, without contaminating the air or offending non-smokers nearby.

While one specific embodiment of the invention has been described in detail above, it is to be understood that various modifications may be made from the specific details described herein without departing from the spirit and scope of the invention which may be practiced within the scope of the claims herein.

I claim the following:

1. A smoking device comprising:

a body having three flat surfaces, one a vertical surface and the other two surfaces extending perpendicularly on the same side from the top and bottom of said vertical surfaces, and having recesses around its perimeter for mating with a cover and filter retainer; and a cover attached to the body on the opposite side of the two perpendicularly extending surfaces, having a tapered rib on its perimeter which mates with a recess in the body to form a seal, having two openings, a bottom opening on a vertical portion of the cover for insertion of a mouthpiece for inhaling a cigarette and a top opening on an inwardly slanting portion of the cover for holding a mouthpiece for exhaling smoke from a cigarette; and a removable mouthpiece for inhalation which is press-fitted into the bottom hole of the cover, the outer end of said mouthpiece being tapered as it extends outward from said cover to a small diameter for insertion in a smoker's mouth, said mouthpiece further having a cigarette holder press-fitted or attached to the inner end of said mouthpiece, said cigarette holder having a tapered end and inner diameter to accomodate cigarettes of varying sizes, said mouthpiece and cigarette holder having a small ball or bearing trapped inside to allow smoke to pass freely through the mouthpiece during inhalation yet seal the mouthpiece during exhalation; and a mouthpiece for exhalation which is press-fitted into the top opening on the inwardly slanted top portion of the cover, having an inner end which press fits into the top opening in the cover, and having a finger molded to the inside thereof which extends inward to the inner end of said mouthpiece where the finger snaps into a hole in the center of a disc to form a low-pressure one-way valve, said disc having a tapered circumference which mates with an inwardly tapered circumference of the inner end of said mouthpiece; and a filter retainer having two flat surfaces which slide over the two perpendicular flat surfaces of the body and have a standing rib around the perimeter that mates into a recess in the body to create a seal therebetween, and which has inwardly extending ribs from the ends of the two flat surfaces for holding two disposable filters, said filters extending between the two flat surfaces of the filter retainer and an inner filter made of HEPA or like material to remove particulates from smoke and an outer filter made of polyurethane foam or like material which is impregnated with charcoal to remove any remaining odor from the air as it passes through the filters into the ambient atmosphere.

2. A hand-held smoking device comprising:

a body having three flat surfaces, one a vertical surface and the other two surfaces extending perpendicularly on the same side from the top and bottom of said vertical surfaces, and having recesses around its perimeter for mating with a cover and filter retainer; and a cover attached to the body on the opposite side of the two perpendicularly extending surfaces, having a tapered rib on its perimeter which mates with a recess in the body to form a seal, having two openings, a bottom opening on a vertical portion of the cover for insertion of a mouthpiece for inhaling a cigarette and a top opening on an inwardly slanting portion of the cover for holding a mouthpiece for exhaling smoke from a cigarette; and a removable mouthpiece for inhalation which is press-fitted into the bottom hole of the cover, the outer end of said mouthpiece tapered as it extends outward from said cover to a small diameter for insertion in a smoker's mouth, said mouthpiece further having a cigarette holder press-fitted or attached to the inner end of said mouthpiece, said cigarette holder having a tapered end and inner diameter to accomodate cigarettes of varying sizes, said mouthpiece and cigarette holder having a small ball or bearing trapped inside to allow smoke to pass freely through the mouthpiece during inhalation yet seal the mouthpiece during exhalation; and a mouthpiece for exhalation which is press-fitted into the top opening on the inwardly slanted top portion of the cover, having an inner end which press fits into the top opening in the cover, and having a finger molded to the inside thereof which extends inward to the inner end of said mouthpiece where the finger snaps into a hole in the center of a disc to form a low-pressure one-way valve, said disc having a tapered circumference which mates with an inwardly tapered circumference of the inner end of said mouthpiece; and a filter retainer having two flat surfaces which slide over the two perpendicular flat surfaces of the body and have a standing rib around the perimeter that mates into a recess in the body to create a seal therebetween, and which has inwardly extending ribs from the ends of the two flat surfaces for holding two disposable filters, said filters extending between the two flat surfaces of the filter retainer and an inner filter made of HEPA or like material to remove particulates from smoke and an outer filter made of polyurethane foam or like material which is impregnated with charcoal to remove any remaining odor from the air as it passes through the filters into the ambient atmosphere.

3. A smoking device comprising:

a means for inhaling a cigarette contained in said device consisting of a removable mouthpiece press-fitted into an opening in the device, the outer end of said mouthpiece being tapered as it extends outward from said opening and having a small diameter for insertion into a smoker's mouth during inhalation;

a means for exhaling smoke into the interior of the device;

a means of filtering the smoke as it passes from the interior of the device to the ambient air; and a means of holding the cigarette enclosed entirely in the device.

4. The smoking device of claim 3 having means of preventing smoke from escaping from the device during exhalation consisting of a ball or bearing inside the inhalation mouthpiece which seals the mouthpiece during exhalation into the device.

5. A smoking device comprising:

a means for inhaling a cigarette contained in said device consisting of a removable mouthpiece press-fitted into an opening in the device, the outer end of said mouthpiece being tapered as it extends outward from said opening and having a small diameter for insertion into a smoker's mouth during inhalation;

a means for exhaling smoke into the interior of said device consisting of a second mouthpiece press fitted into a second opening in the device, siad mouthpiece having a finger molded to the inside thereof which extends inward to the inner end of said mouthpiece where the finger snaps into a hole in the center of a disk to form a low pressure, one-way valve, said disk having a tapered circumference which mates with the inwardly tapered circumference of said mouthpiece;

a means of filtering the smoke as it passes from the interior of the device to the ambient air; and a means of holding the cigarette enclosed entirely in the device.

6. A smoking device comprising:

a means for inhaling a cigarette contained in said into the device consisting of a removable mouthpiece press-fitted into an opening in the device, the outer end of said mouthpiece being tapered as it extends outward from said opening and having a small diameter for insertion into a smoker's mouth during inhalation;

a means for exhaling smoke into the interior of said device consisting of a second mouthpiece press fitted into a second opening in the device, said mouthpiece having a finger molded to the inside thereof which extends inward to the inner end of said mouthpiece where the finger snaps into a hole in the center of a disk to form a low pressure, one-way valve, said disk having a tapered circumference which mates with the inwardly tapered circumference of said mouthpiece;

a means of filtering the smoke as it passes from the interior of the device to the ambient air consisting of two filters, an inner filter for removing particulates from the smoke and an outer figure which may be made of polyurethane foam or like material and impregnated with charcoal, to remove any remaining odor from the air as it passes through the filter into the ambient atmosphere; and a means of holding the cigarette enclosed entirely in the device.

7. A smoking device comprising:

a means for inhaling a cigarette contained in said device consisting of a removable mouthpiece press-fitted into an opening in the device, the outer end of said mouthpiece being tapered as it extends outward from said opening and having a small diameter for insertion into a smoker's mouth during inhalation;

a means for exhaling smoke into the interior of said device consisting of a second mouthpiece press fitted into a second opening in the device, said mouthpiece having a finger molded to the inside thereof which extends inward to the inner end of said mouthpiece where the finger snaps into a hole in the center of a disk to form a low pressure, one-way valve, said disk having a tapered circumference which mates with the inwardly tapered circumference of said mouthpiece;

a means of filtering the smoke as it passes from the interior of the device to the ambient air consisting of two filters, an inner filter for removing particulates from the smoke and an outer figure, which may be made of polyurethane foam or like material and impregnated with charcoal, to remove any remaining odor from the air as it passes through the filter into the ambient atmosphere; and a means of holding the cigarette enclosed entirely inside the device consisting of a cigarette holder press-fitted into or attached to the inner end of an inhalation mouthpiece having a tapered end and inner diameter to accomodate cigarettes of varying sizes.

* * * * *